US005272683A

United States Patent [19]

Jackl

[11] Patent Number: 5,272,683

[45] Date of Patent: Dec. 21, 1993

[54] END CONNECTOR ASSEMBLY FOR WATCH BAND

[75] Inventor: Werner Jackl, Coventry, R.I.

[73] Assignee: Textron Inc., Providence, R.I.

[21] Appl. No.: 886,773

[22] Filed: May 20, 1992

[51] Int. Cl.[5] ..... G04B 37/00

[52] U.S. Cl. ..... 368/282; 224/164

[58] Field of Search ..... 368/281, 282; 224/164–180

[56] References Cited

U.S. PATENT DOCUMENTS

| | | | |
|---|---|---|---|
| 4,270,201 | 5/1981 | Pyne et al. | 368/282 |
| 4,624,581 | 11/1986 | Mock et al. | 368/282 |
| 4,949,433 | 8/1990 | Bert | 224/168 |
| 4,958,334 | 9/1990 | Grosjean | 368/282 |
| 5,158,219 | 10/1992 | Baumgartner et al. | 224/164 |

FOREIGN PATENT DOCUMENTS

| | | |
|---|---|---|
| 0167891 | 1/1986 | European Pat. Off. . |
| 60-220889 | 11/1985 | Japan . |
| 659572 | 2/1987 | Switzerland . |
| 667784 | 11/1988 | Switzerland . |

*Primary Examiner*—Bernard Roskoski

*Attorney, Agent, or Firm*—Samuels, Gauthier & Stevens

[57] ABSTRACT

An end connector has a plastic outer shell pivotally coupled to a plastic watch case by means of a metallic cross pin. The outer shell has a recess in its bottom surface which is configured and dimensioned to receive at least one and preferably two of the end most top links of a respective end of the band. A metallic insert is interposed between the outer shell and the thus received top links. The insert is mechanically inter engaged with both the cross pin and the thus received top links, thereby establishing a secure coupling of the band of the watchcase.

5 Claims, 3 Drawing Sheets

END CONNECTOR ASSEMBLY FOR WATCH BAND

BACKGROUND OF THE INVENTION

1. Field of the Invention

This invention relates generally to expansible watch bands, and is concerned in particular with an improved end connector assembly for coupling the ends of such bands to watches having watch cases molded from plastic materials such as for example ABS.

21 . Description of the Prior Art

The conventional expansible watch band typically includes a row of top links overlying a row of bottom links, with each bottom link being connected to two adjacent top links by pairs of U-shaped staples. Springs housed in the links coact with the staples to yieldably contract the band. The top and bottom links as well as the staples and springs are typically fabricated as metal stampings, and the top links are usually covered with decorative metallic top shells.

In the past, as disclosed for example in U.S. Pat. No. 4,958,334 (Grosjean), such watch bands have been coupled to plastic watch cases by end connector assemblies employing both metallic and plastic components. Here, the metallic components are externally located to conform in appearance to the metallic band, and the plastic components are internally arranged to isolate the plastic watch case from damaging frictional contact with the metallic band and end connector components.

While this arrangement is generally satisfactory from the standpoint of structural integrity and wear resistance, it has certain styling drawbacks resulting from the stark visual contrast between the metallic band and the plastic watch case.

A uniform appearance can be achieved by applying a metal cap to the watchcase, but this eliminates the styling possibilities afforded by the wide color variations which are available with plastic materials.

In light of the foregoing, recent design proposals have focused more on conforming the appearance of the band to the plastic watch case. In addition to replacing the conventional metallic top shells with plastic top shells, this also requires a redesign of the end connector assembly in order to reverse the location of the metallic and plastic components, thereby placing the plastic component on the outside where it blends visually with the plastic watchcase and plastic top shells. The present invention is directed to this redesign of the end connector assembly.

SUMMARY OF THE INVENTION

The basic objective of the present invention is to provide an end connector assembly which is visually and functionally compatible with both a plastic watchcase and the plastic top shells of a metallic expansion band.

A companion objective of the present invention is the provision of an end connector assembly which provides a secure and reliable metallic coupling of the watch band to the watch case.

In a preferred embodiment of the invention to be described hereinafter in more detail, these and other objectives and advantages are achieved by an end connector assembly having a plastic outer shell pivotally coupled to the plastic watch case by means of a metallic cross pin. The outer shell has a recess in its bottom surface which is configured and dimensioned to receive at least one and preferably two of the end most top links of a respective end of the band. A metallic insert is interposed between the outer shell and the thus received top links. The insert is mechanically inter engaged with both the cross pin and the thus received top links, thereby establishing a secure coupling of the band to the watchcase. The plastic outer shell conforms visually and aesthetically with both the plastic top shells of the band and the plastic watch case.

DETAILED DESCRIPTION OF PREFERRED EMBODIMENT

Figure 1:
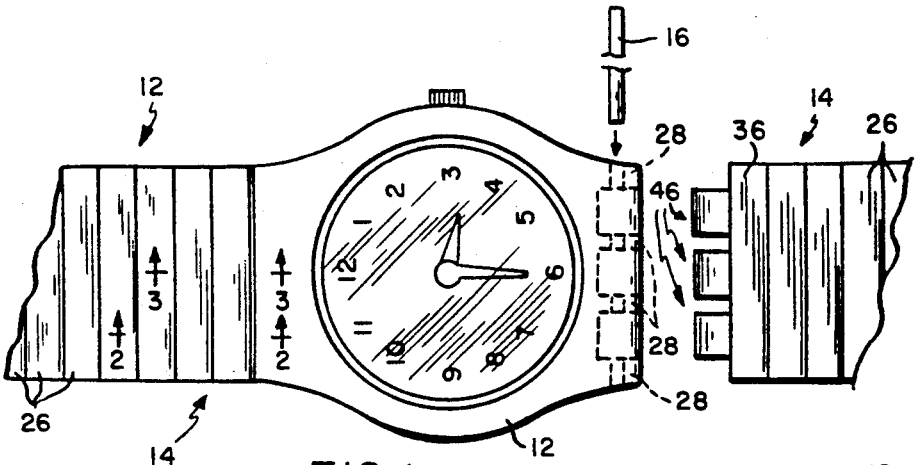
FIG. 1 is a partial top plan view showing a watch band connected at one end to a plastic watch case by means of an end connector in accordance with the present invention, and showing the opposite end of the band uncoupled from the watch case.
Figure 2:
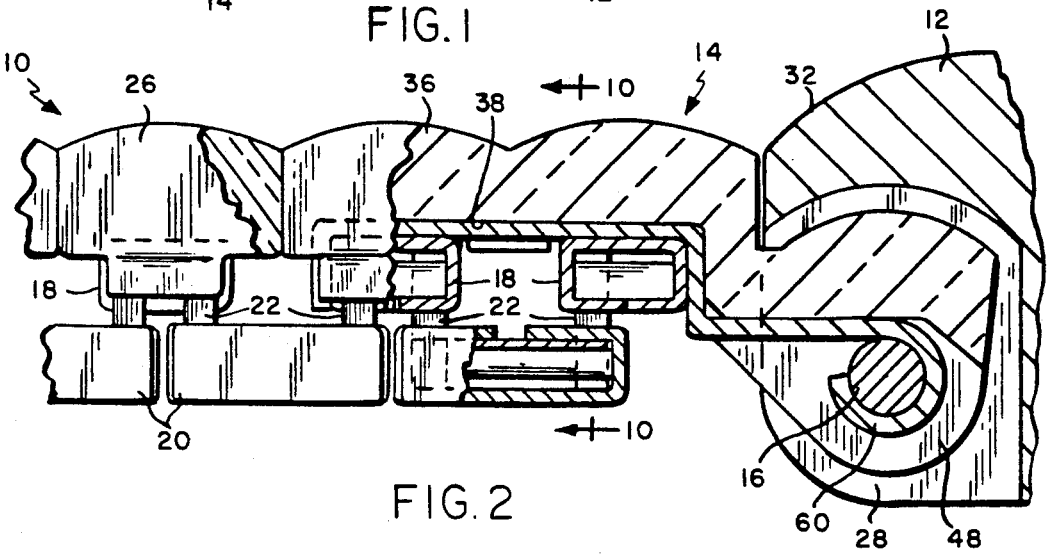
FIG. 2 is a sectional view on an enlarged scale taken along line 2—2 of FIG. 1.
Figure 3:
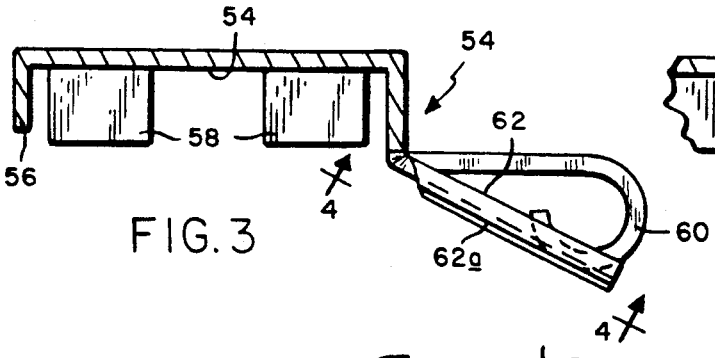
FIG. 3 is an enlarged sectional view taken through the metallic insert at a location indicated by lines 3—3 in FIG. 1.

Referring initially to FIG. 1, one end of an expansible watch band 10 is shown coupled to a plastic watch case 12 by means of an end connector assembly 14 in accordance with the present invention. The end connector assembly at the opposite end of the band is shown uncoupled from the watchcase as result of the extraction of the metallic cross pin 16.

Referring additionally to the remaining drawings, it will be seen that the watch band is of known construction, comprising a row of top links 18 overlying a row of bottom links 20. Each bottom link 20 is connected to two top links 18 by means of opposing pairs of U-shaped staples 22, the latter being acted upon by leaf springs 24 housed in the links. The leaf springs coact in resilient engagement with the staples to accommodate longitudinal expansion and contraction of the band in a manner well known to those skilled in the art.

The top links 18 are covered by decorative plastic top shells 26 which are the subject of a copending application being filed concurrently herewith. The top and bottom links 18, 20 and the staples 22 and springs 24 are all fabricated as metallic stampings, whereas the top shells 26 comprise molded components which are visually compatible with the plastic watch case 12.

The plastic watch case 12 has opposite sides configured to provide mutually spaced ribs 28 with aligned first apertures 30 extending therethrough. The ribs 28 underlie an integral shelf portion 32 of the watch case and define first sockets 34 therebetween.

Figure 6:
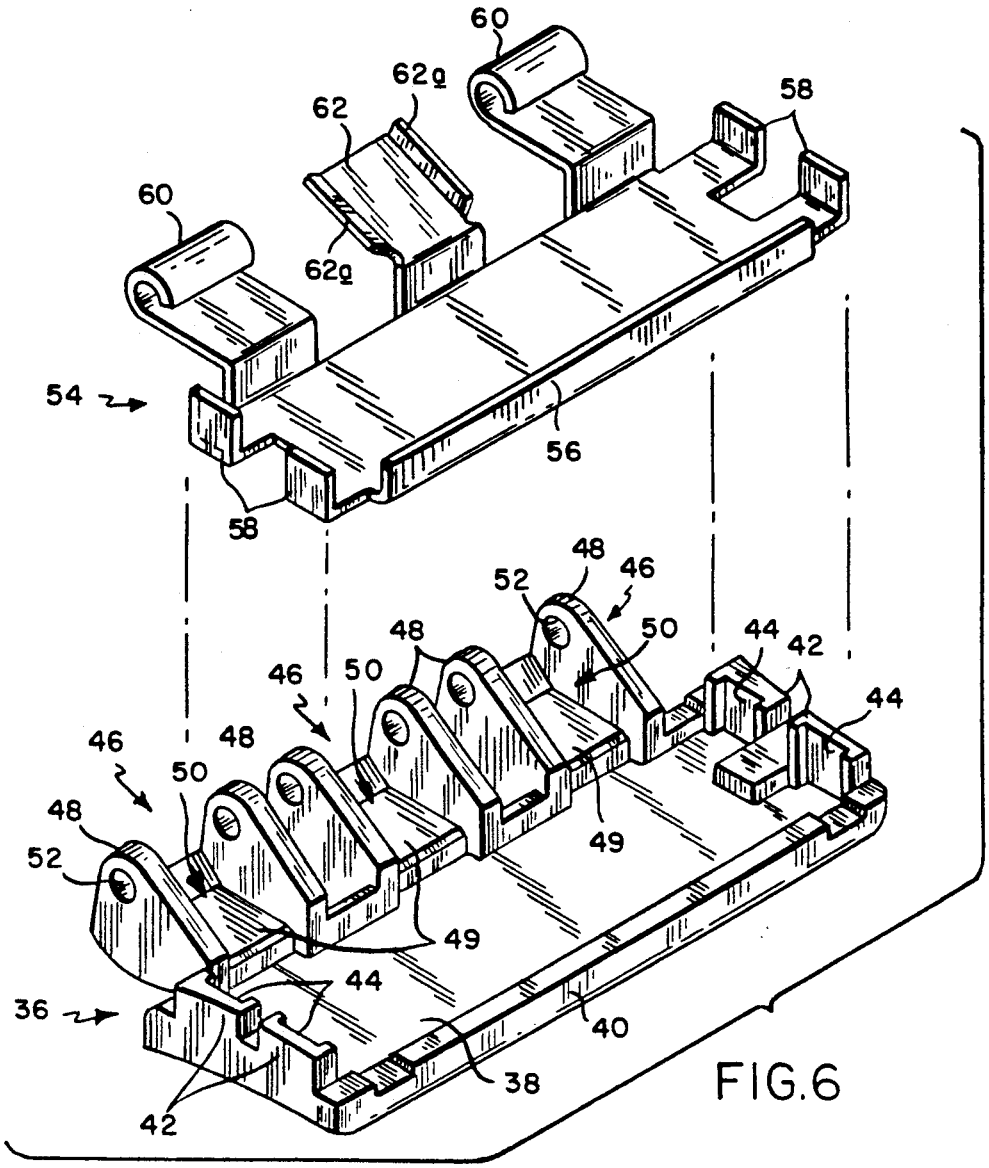
FIG. 6 is an exploded perspective view of the plastic outer shell and the metallic insert.

The end connector assembly 14 includes a plastic outer shell 36 having a contoured top surface adapted and configured to blend aesthetically with the pattern of the plastic top shells 26 as well as with the watch case 12. As can be best seen in FIG. 6, the outer shell 36 has a recess 38 in its bottom surface configured and dimensioned to receive at least one and preferably two top links 18. The recess 38 is bordered by a rear wall 40, and by side walls defining bendable side tabs 42. The side tabs are internally recessed as at 44.

Figure 8:
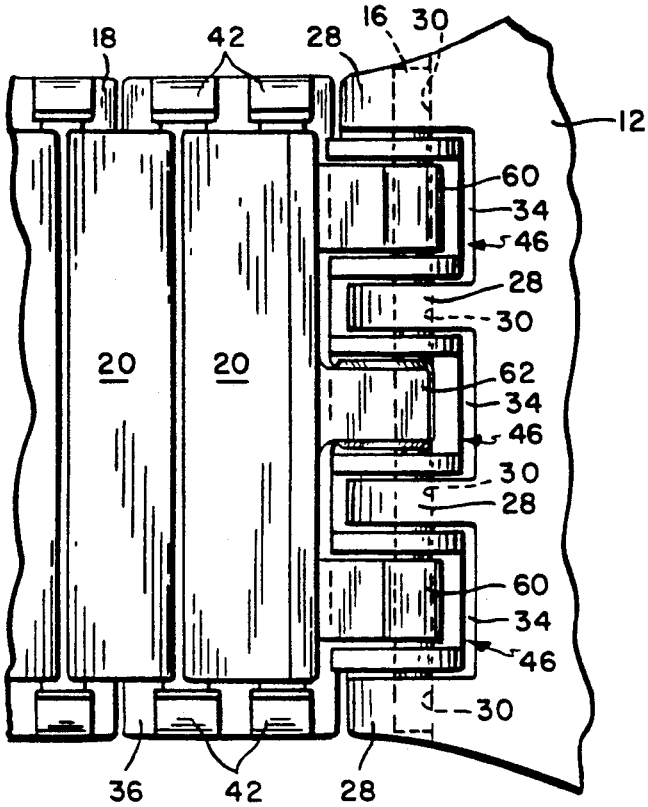
FIG. 8 is a bottom plan view of the end connector assembly coupled shell to the watch case.

The outer shell 36 is additionally provided with mutually spaced forwardly protruding lugs 46, each consisting of side walls 48 interconnected by roof portions 49 to thereby define second sockets 50. The side walls 48 of the lugs 46 have second aligned apertures indicated typically at 52 extending therethrough. As can best be seen in FIG. 8, the lugs 46 are adapted to be received in the first sockets 34 of a respective side of the watch case 12, with the second lug apertures 52 being aligned with the first apertures 30 of the ribs 30 to thereby receive the cross pin 16, the latter establishing a pivotal connection between the watch case and the outer shell 36.

A metallic insert 54 is interposed in the recess 38 between the plastic outer shell 36 and the end most top links 18 received therein. The insert 54 has a rear wall 56, side tabs 58, and forwardly protruding hook-shaped extensions 60 spaced on either side of an intermediate forwarding protruding keeper flange 62.

Figure 7:
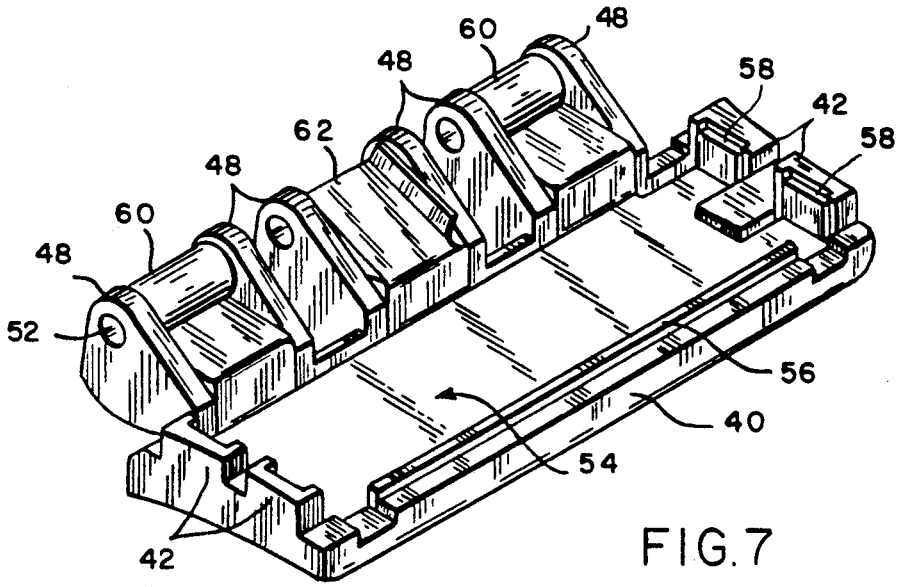
FIG. 7 is an assembled perspective view of the plastic outer shell and metallic insert.

With reference to FIG. 7, it will be seen that when the insert 54 is received in the recess 38 of the outer shell 36, rear wall 56 is lodged behind rear wall 40, side tabs 58 are received in the recesses 44 of side tabs 42, the hook-shaped extensions 60 are received in the second sockets 50 of the outermost lugs 46, and the flange 62 is received in the second socket 50 of the middle lug 46.

Figure 5A:
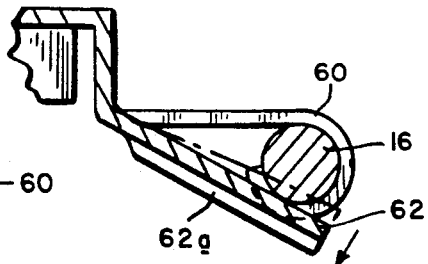
FIGS. 5A and 5B are sectional views taken respectively along lines 5A—5A and 5B—5B of FIG. 4, with FIG. 5A depicting the resilient deflection of the keeper flange effected by insertion of the cross pin.
Figure 4:
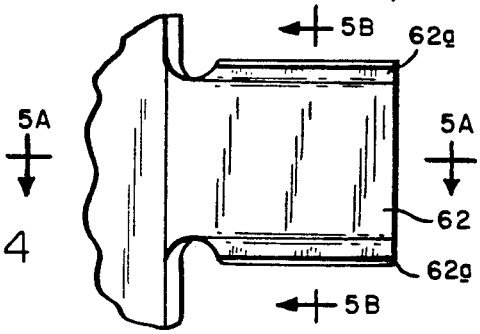
FIG. 4 is a partial external view of the insert taken along line 4–4 of FIG. 3.
Figure 5B:
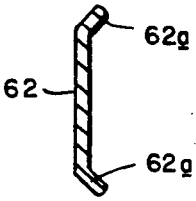

The hook-shaped portions 60 are configured to mechanically engage the cross pin 16. In order to avoid overly stressing and possibly fracturing the walls 48 of the lugs 46 and/or the flanges 28 of the watch case, the cross pin 16 is inserted through the aligned first and second apertures 30,52 with only a slight interference fit. This slight interference fit is insufficient to reliably retain the cross pin in its inserted position. However, pin retention is assured by the keeper flange 62, which, as shown in FIG. 5A, is resiliently deflected by pin insertion, thereby establishing adequate frictional resistance to insure that the pin remains securely inserted. Preferably, the keeper flange 62 is provided with downturned side edges **62*a* which facilitate through insertion of the cross pin 16**.

Figure 10:
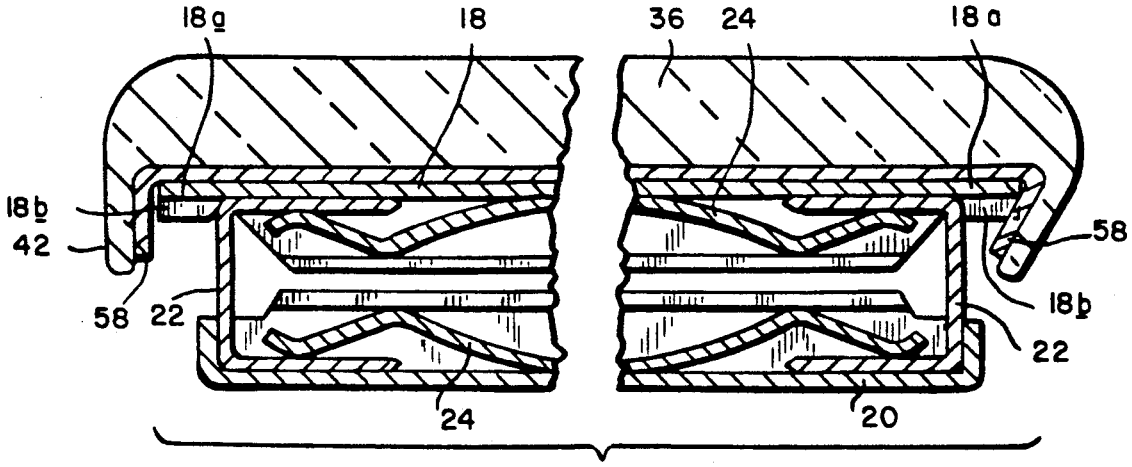
FIG. 10 is a sectional view taken along line 9—9 of FIG. 2 with opposite sides respectively showing the side tabs of the outer plastic shell and metallic insert before and after bending to effect connection of the connector assembly to the watch band.
Figure 9:
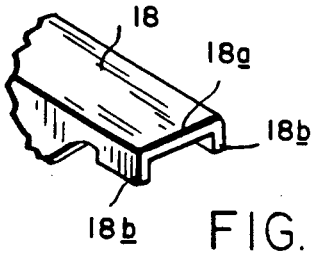
FIG. 9 is a partial perspective view of an end portion of a top link of the band.

It will be seen from FIG. 10 that the ends of the top links 18 protrude beyond the ends of the bottom links 20. As shown in FIG. 9, each top link end is open, and defined by a top wall portion **18*a*, and side wall portions 18*b***.

When attaching the end connector assembly 14 to an end of the watch band 10, the end most top links 18 are first positioned in the recess 38 of the top shell 36, the latter having first been lined with the metallic insert 54 (as shown in FIG. 7). At this point, as shown on the left-hand side of FIG. 10, the metal tabs 58 of the insert lie behind the tabs 42 of the outer shell and simply extend downwardly past the open ends of the top shells 18. A tool (not shown) is then employed to bend the overlapping tabs 42, 58 inwardly towards the center of the band. As a result and as shown at the right-hand side of FIG. 10, the metallic tabs 58 of the insert are forced into the open ends of the top shells and into mechanical interengagement between the side wall segments **18*b*. At the same time, the plastic tabs 42 are also inwardly deformed to tightly overlap the inwardly deformed tabs 58**.

The interengagement of the metallic tabs 58 between the metallic side wall segments **18*b* of the top shells 18, in combination with the mechanical engagement of the hook portions 60 with the cross pin 16, insures that the band is securely coupled to the watch case, without in any way detracting from the aesthetically pleasing appearance provided by the plastic outer shell 36 acting as a decorative bridging element between the plastic top shells 26 of the band and the plastic watch case 12**.

As shown in the drawings, the plastic top shells 26 and the plastic outer shell 36 can, if desired, be molded of transparent or translucent materials. Alternatively, opaque colored materials may be used. The possibilities are virtually unlimited.

I claim:

1. In the combination of a watchband having an end thereof coupled to a watchcase by an end connector said watchband having top and bottom metallic links interconnected by spring biased connecting elements in a manner accommodating longitudinal expansion and contraction of the band, said watchcase having opposite sides configured to provide mutually spaced ribs with aligned first apertures extending therethrough, said ribs defining first sockets therebetween, said end connector comprising:

a plastic outer shell having a recess in its bottom surface configured and dimensioned to receive at least one top link at a respective end of said band, said outer shell having mutually spaced lugs with aligned second apertures extending therethrough and defining second sockets, said lugs being adapted to be received in said first sockets with said first and second apertures in mutual alignment;

a metallic pin inserted through said aligned first and second apertures to establish a pivotal connection between said watch case and said plastic outer shell; and a metallic insert interposed in said recess between said plastic outer shell and the said at least one top link, said insert having hook-shaped extensions protruding into at least some of said second sockets to coact in mechanical interengagement with the thus inserted metallic pin.

2. The combination of claim 1 wherein said insert is further provided with a keeper flange extending into one of said second sockets said flange being resiliently deflected by and in frictional contact with the thus inserted pin.

3. The combination of claim 1 wherein said top links have open ends defined by top and side wall segments, and wherein said insert further includes side tabs bendably deformable into said open ends and into mechanical interengagement between said side wall segments.

4. The combination of claim 3 wherein said outer shell includes side tabs overlapping and bendably deformable with the side tabs on said insert.

5. The combination of claim 2 wherein the frictional contact between said pin and said ribs and lugs is insufficient to reliably maintain said pin in its inserted position, and wherein the resilient contact of said keeper flange with said pin frictionally resists dislocation of said pin from said inserted position.

* * * * *